United States Patent [19]

Kim

[11] 4,130,937

[45] Dec. 26, 1978

[54] NAIL CLIPPER

[76] Inventor: Young M. Kim, 511 N. Bandini, San Pedro, Calif. 90731

[21] Appl. No.: 876,695

[22] Filed: Feb. 10, 1978

[51] Int. Cl.[2] ..... A45D 29/02

[52] U.S. Cl. ..... 30/28

[58] Field of Search ..... 30/28, 124; 132/75.5

[56] References Cited

U.S. PATENT DOCUMENTS

| | | | |
|---|---|---|---|
| 2,799,923 | 7/1957 | Senshu | 30/28 |
| 2,887,773 | 5/1959 | Killen | 30/28 |
| 2,970,376 | 2/1961 | Kuo | 30/28 |
| 3,031,754 | 5/1962 | Pocoski | 30/28 |
| 3,855,698 | 12/1974 | Crosby | 30/28 |
| 3,986,257 | 10/1976 | Kiura | 30/28 |

*Primary Examiner*—Jimmy C. Peters
*Attorney, Agent, or Firm*—Erik M. Arnhem

[57] ABSTRACT

Two bi-laterally flanged plates with length portions of their respective flanges nested movably within one another the remaining portions thereof being fused together; the free ends of the movable portions of the plates form cutting edges; a band encompasses the plates adjacent the cutting edges and is mounted onto one plate surface; a lever member, mounted hingedly and turnably onto the band is provided on both sides with protuberances; the member, when functioning as a lever, causes the cutting edges to register, and when turned into a non-levering position, to remain closed. The rear end of the plates is closed by a cap.

4 Claims, 4 Drawing Figures

NAIL CLIPPER

BACKGROUND OF THE INVENTION

My invention relates to a nail clipper, additionally constituted as a receptacle, into which cut nails clippings may be dropped automatically and unhindered, and also remain securely therein, until removed.

The following U.S. patents, constituting the developed pertinent prior art, are cited below: U.S. Pat. Nos.; 949,799, RABE, 1910; 2,179,435, SMITH, 1939; 2,515,852, BILSKY, 1950; 2,799,923, SENSHU, 1957; 3,986,257, KIURA, 1976.

None of the above cited references discloses a construction of a nail clipper similar to the invented device as described herein.

For example KIURA does only provide for temporary retention of nail clippings within a semi-closed interior space. Its lever is mounted to a cross-bar, that may hinder the clipping from dropping into the space. The remaining cited prior art presents either drawbacks similar to those of KIURA or one of an entirely different and more complicated construction.

SUMMARY OF THE INVENTION

It is an object of the invention to provide a nail clipper with a receptacle, which will permit its user to cut his nails and simultaneously cause the nail clippings to drop unhindered into a receptacle for retention therewithin.

It is a further object of the invention to provide a nail clipper device capable of having its cutting edges brought tightly together, when in an inactive state, to prevent nail clipping from escaping involuntarily from the receptacle.

It is still a further object of the invention to provide a smoothly working nail clipper having side walls which are partly movably relative to one another, and partly fused together.

It is still another object of the invention to provide a removable closure at the rear open end of the nail clipper receptacle through which nail clippings, stored therein, may be disposed of.

As noted above, my invention embodies a novel construction of a nail clipper with a, preferably rectangularly shaped housing, into which nail clipping — subsequent to having been cut may drop unhindered through the gap existing between its two cutting edges. The housing or receptacle is formed by two laterally flanged cover plates, respectively terminating in a cutting edge; each flanged cover plate forms one U-shaped half of the receptacle. The two halves of the receptacle are then mounted in such a way, that a substantial length portion of their flanges, respectively are nested loosely movable within one another, while the remaining flange portions constitute an integral whole.

A band, mounted rigidly to one of the cover plate surfaces and encompassing both of the cover plates, adjacent their cutting edges constitutes the base mount for a lever, which is mounted hingedly and pivotally thereon.

The lever is provided with at least one projection or protuberance on each of its side surfaces adjacent its mount on the clipper.

When the lever is pivoted into a levering position, (i.e., forming approx. a 45° angle with the cover plate) the projection or protuberance acts as a fulcrum and provides the needed thrust — when the lever is pressed down — to compress the two cutting edges for clipping action; the subsequent release of the lever will bring the cutting edges apart, causing a clipped nail to drop into the receptacle formed by the flanged plates of the clipper.

There are no moving or fixed components arranged or mounted inside the nail clipper, that could prevent or delay a frictionless dropping of nail clippings into the receptacle.

When the lever is pivoted into a resting position, (i.e., lies adjacent to the cover plate), the other projection or curvature — opposite the fulcrum — will exert pressure against the upper part of the cover-plate and thus cause the cutting edges to compress and remain tightly together, until again released by turning the lever into its angular levering position. The latter measure and a cap provided at the rear open end of the nail clipper will provide a completely enclosed but easily openable receptacle for the nail clippings.

DESCRIPTION OF THE PREFERRED EMBODIMENT

Figure 1:
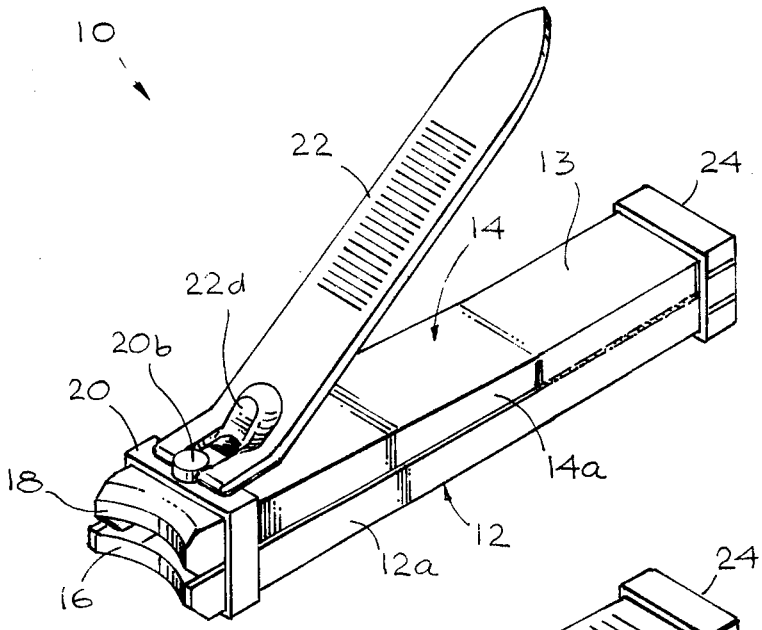
FIG. 1 is a perspective view of the nail clipper with a lever in its levering position.

In the drawings like reference characters designate similar parts in the several views of the invention.

Referring now in detail to the drawings, numeral 10 in FIG. 1, indicates the nail clipper, which comprises two substantially U-shaped cover plates 12 and 14, having, when mounted together mutually overlapping flanges **12*a* and 14*a*, so constituted that the front portions of flanges 12*a* and 14*a*** are nested vertically movable within one another, while their rear portions are fused, bonded or otherwise united, so as to constitute an integral or closed whole.

The extreme horizontal front edges of the cover plates 12 and 14 are extended to form, two oppositely disposed cutting edges, 16 and 18.

Figure 2:
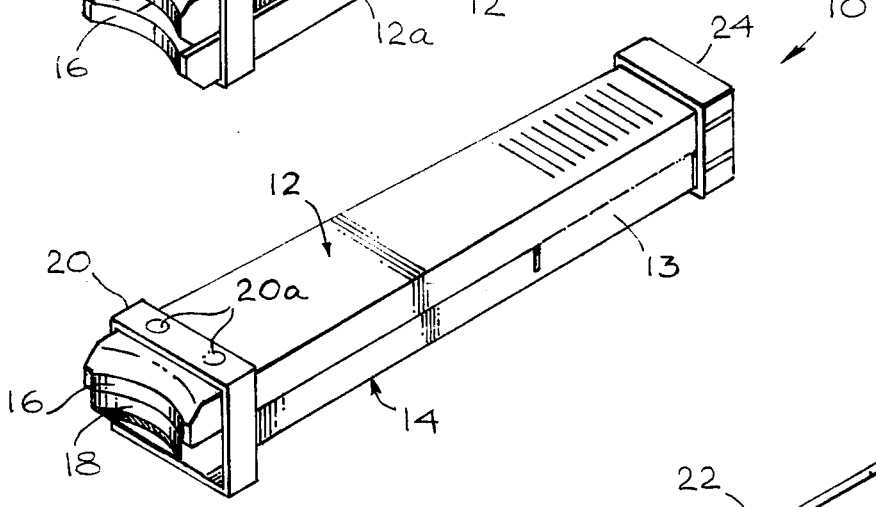
FIG. 2 is a perspective upside down view of the same nail clipper with the lever removed.
Figure 3:
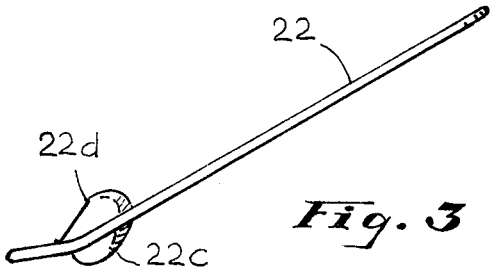
FIG. 3 is a side view of the lever.
Figure 4:
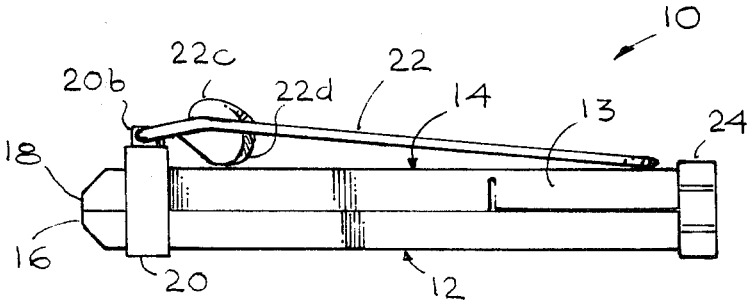
FIG. 4 is a side view of the nail clipper with the lever in inactive position.

A substantially band shaped support means 20 (FIG. 3) encompasses the two cover plates 12 and 14 adjacent cutting edges 16 and 18. The band shaped support means 20 is rigidly mounted at the bottom surface side of the nail clipper 10, as indicated at **20*a* in FIG. 2; the remaining interior portion of support means 20 passes unattached but tightly around cover plates 12 and 14. The center portion of the support means 20 on the top surface of cover plates 12 and 14 (FIG. 1) may be provided with a small knob-like projection 20*b* in order to accommodate lever 22** hingedly and turnably thereon.

The front end of lever 22 is somewhat curved and provided e.g. with a semi-closed aperture to easily snap into projection **20*b***.

The two oppositely situated front portions of lever 22 are provided with or formed as rounded protuberances or curvatures, **22*c* and 22*d*** protruding substantially therefrom.

As noted above, lever 22 pivots on projection **20*b* mounted on band or ring 20, and may be turned so that either of its surfaces face the upper cover plate 14**.

When lever 22 is turned into a levering position, its protruberance **22*c* will rest on cover plate 14** and place lever 22 at about a 40 degrees angle with the former. Protuberance 22*c* will then act as a fulcrum when lever 22 is pressed downwardly and cause the separated cutting edges 16 and 18 to register and cut nails placed therewithin.

Plate 14 is provided with at least one relief cut extending vertically across its flanges preferably at the location where the movable and fused flange portions coincide, as indicated on the drawing. The relief cut will increase the resilient down and upward mobility of plate 14 relative to plate 12.

As noted above, the shorter rear portions of cover plates 12 and 14 are fused or bonded together to form a closed receptacle 13, the open end of which is closable by a removable cap 24.

When lever 22 is actuated, causing edges 16 and 18 of the nail clipper to register and cut nails, the nail parings may easily be caused to drop between cutting edges 16 and 18 and down into receptacle 13.

When lever 22 is inactive, i.e. pivoted around so that its surface with protuberance 22*d* bears on cover plate 14, protruberance 22*d* will exert a forceful pressure on the latter and cause the gap between edges 16 and 18 to close and thereby prevent nail clippings in the receptacle 13 to escape through the front end of the clipper.

When it becomes desirable to remove the nail clippings from receptacle 13, one simply detaches cap 24, and empties the interior of nail clipper 10.

The resiliency and effectiveness of the nail clipper and its cutting actions are considerably enhanced due to the moveability of the front sections of the flanged cover plates relative to one another.

While the foregoing has illustrated and described what is now contemplated to be the best mode of carrying out the invention, the description is, of course, subject to modifications without departing from the spirit and scope of the invention. Therefore, it is not desired to restrict the invention to the particular constructions illustrated and described, but to cover all modifications that may fall within the scope of the appended Claims.

I claim:

1. A nail clipper, comprising:

(a) two bilaterally flanged plates mounted within one another to form a receptacle;

(b) two cutting edges respectively, extending facing one another from one end of the plates;

(c) a band encompassing the two plates fastened to one of the plates;

(d) a lever mounted turnably on the band, each surface of the lever having a protuberance alternately constituting a fulcrum between lever and plate surface, respectively abutting the plate surface, causing the cutting edges to close;

(e) a closure covering the other end of the receptacle forming two plates.

2. A nail clipper, according to claim 1, wherein length portions of the flanges of the plates are nested vertically movable within one another, with the remaining length portions thereof being fused together.

3. A nail clipper, according to claim 2, wherein the flanges of one plate respectively are provided with at least one relief cut.

4. A nail clipper, comprising:

(a) two bilaterally flanged plates inserted in one another to form a housing, one end of which being constituted as two oppositely disposed cutting edges, the largest length portions of the flanges of the plates extend nested vertically movable within one another, the remaining length portions thereof are integrally united with one another, the flanges of one of the plates having, respectively at least one crosswise extending relief cut substantially at the location where movable and integrally united flanges coincide;

(b) a band encompassing the housing forming plates adjacent their cutting edges, is rigidly mounted onto one of the surfaces of the plates;

(c) a lever, mounted hingedly and turnably on the band, each opposite surfaces of which having a protuberance, alternately constituting a fulcrum between lever and plate surface respectively abutting the plate surface causing the cutting edges to close tightly;

(d) a cap covering the other end of the housing forming two plates.

* * * * *